US005337427A

United States Patent [19]

Pagano et al.

[11] Patent Number: 5,337,427

[45] Date of Patent: Aug. 16, 1994

[54] BIRTHING BOARD

[76] Inventors: Anthony M. Pagano, 11911 Kingbird Ct., Penn Valley, Calif. 95946; David H. Tuman, 5001 Miners Ranch Rd., Oroville, Calif. 95966; Margaret E. Pagano, 11911 Kingbird Ct., Penn Valley, Calif. 95946

[21] Appl. No.: 931,674

[22] Filed: Aug. 18, 1992

[51] Int. Cl.[5] ..... A61G 7/065; A61G 7/07; A61G 15/00

[52] U.S. Cl. ..... 5/602; 5/630; 128/845

[58] Field of Search ..... 5/602, 632, 630, 662, 5/652; 128/845; 606/240; 482/140, 142; 280/16-19

[56] References Cited

U.S. PATENT DOCUMENTS

| | | | |
|---|---|---|---|
| 136,663 | 3/1873 | Moore | 5/602 |
| 597,473 | 1/1898 | Swain | 5/602 |
| 1,904,039 | 4/1933 | Bruder | 5/420 |
| 2,558,105 | 6/1951 | Schinman | 5/423 |
| 2,732,269 | 1/1956 | Astroff | 311/11 |
| 2,819,133 | 1/1958 | Party | 311/11 |
| 3,359,577 | 12/1967 | Rogers | 5/630 |
| 4,180,062 | 12/1979 | Alberti et al. | 5/602 |
| 4,247,091 | 1/1981 | Giowacki et al. | 5/602 |
| 4,703,975 | 11/1987 | Roberts et al. | 5/602 |
| 4,715,592 | 12/1987 | Lewis | 269/328 |
| 4,752,067 | 6/1988 | Colonello | 482/142 |
| 5,207,704 | 5/1993 | Shields | 606/240 |

FOREIGN PATENT DOCUMENTS

| | | | |
|---|---|---|---|
| 8900333 | 9/1990 | Netherlands | 128/845 |

OTHER PUBLICATIONS

Fitness Quest, "Abdomenizer Instruction Manual", copyright 1990.

Declaration of Dr. Anthony M. Pagano, dated Dec. 24, 1993.

*Primary Examiner*—Alexander Grosz

*Attorney, Agent, or Firm*—Limbach & Limbach

[57] ABSTRACT

A birthing board is disclosed which is portable, simple, and inexpensive. The birthing board has a top surface, a bottom surface, a front end and a back end with the front end being substantially thicker than the back end, so that the top surface is generally inclined from the back end to the front end. The top surface is curved to provide lumbar and pelvic support along a central axis which extends from the front end to the back end, and has a concave shape to support a woman's buttocks and hips in the vicinity of the front end and in a dimension transverse to the central axis. The front end is recessed in the vicinity of the central axis. The bottom surface of the board is convex in shape in a dimension transverse to the central axis and generally level in dimension parallel to the central axis.

15 Claims, 9 Drawing Sheets

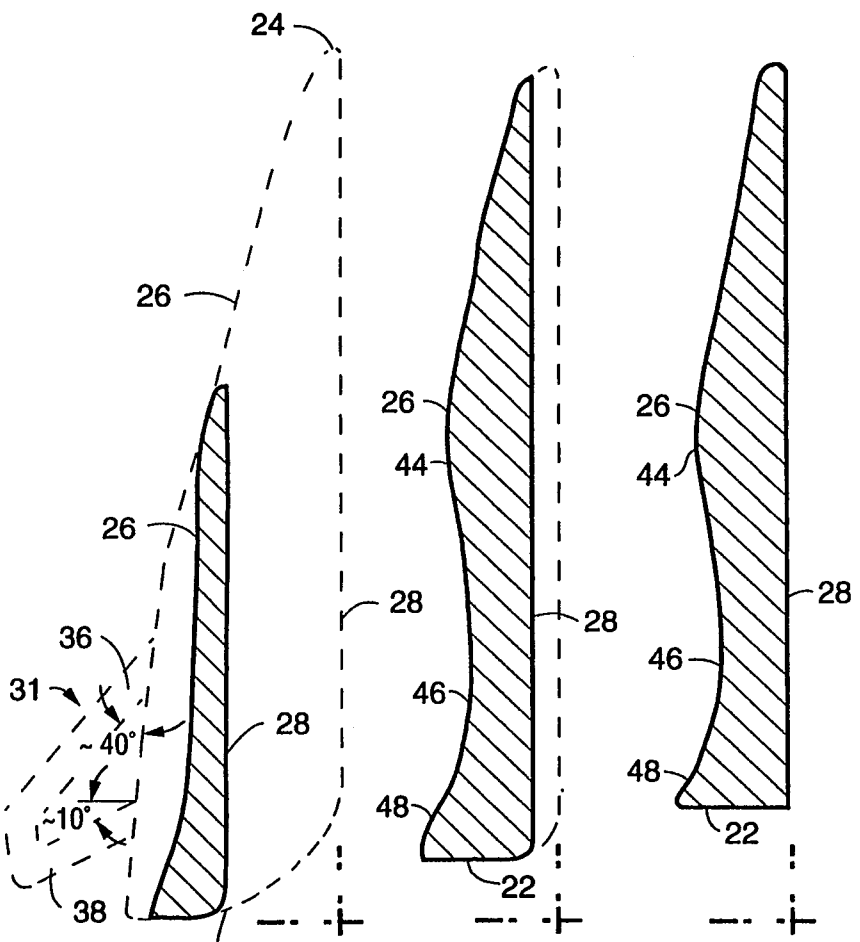
FIG. 7C
FIG. 7B
FIG. 7A
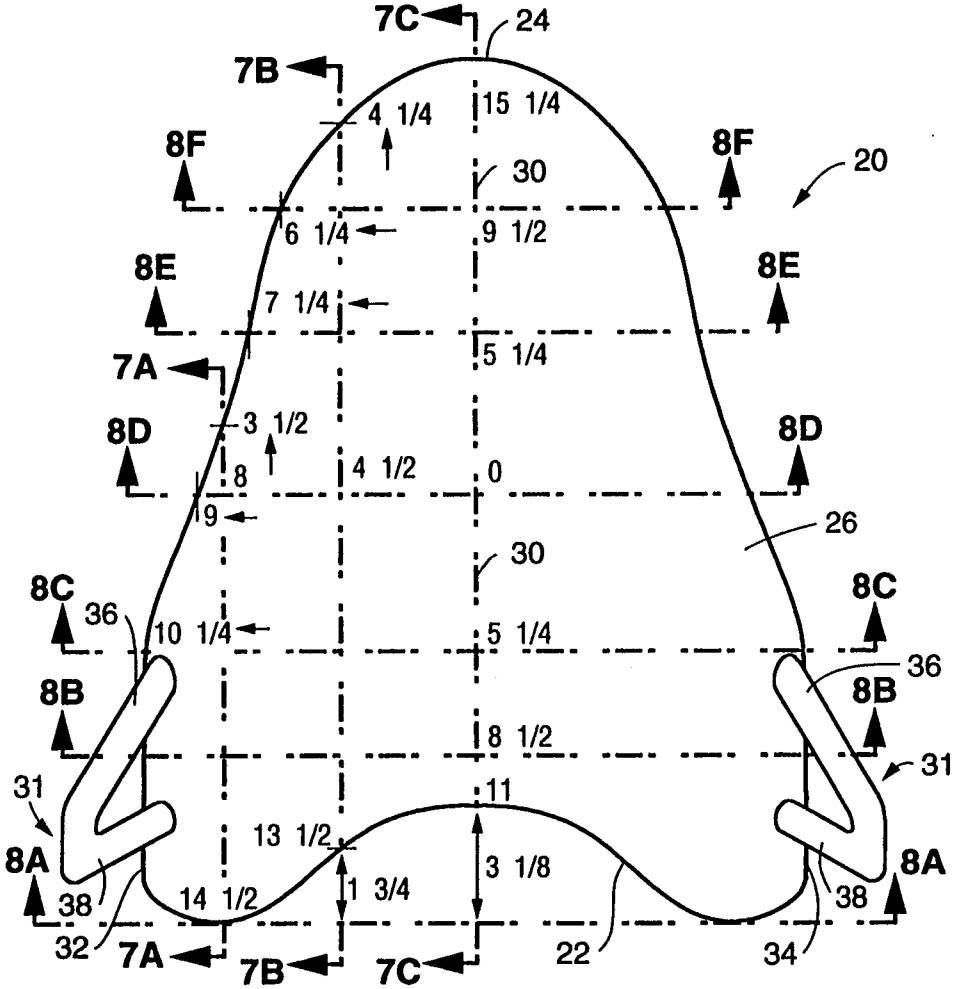
FIG. 6

BIRTHING BOARD

TECHNICAL FIELD

The present invention is directed to a birthing apparatus, and more particularly to a portable birthing board designed to help brace and support the lower back and pelvis of a woman during labor and delivery.

BACKGROUND ART

In obstetrics there have been many attempts at providing birthing chairs, beds, or structures designed to support a woman during labor and delivery of a baby. These structures include the birthing chair shown in U.S. Pat. No. 4,703,975 to Roberts et al.; the portable child birth chair shown in U.S. Pat. No. 4,180,062 to Alberti et al.; the accouchement couches disclosed in U.S. Pat. No. 136,663 to Moore; the safety accouchement chair shown in U.S. Pat. No. 597,473 to Swain; the adjustable labor delivery recovery hospital bed shown in U.S. Pat. No. 4,247,091 to Glowacki et al.; and the gantries for accouchement and gynecological purposes shown in U.S. Pat. No. 2,819,133 to Party; the accouchement apparatus shown in U.S. Pat. No. 4,715,592 to Lewis; and the arm and leg support shown in U.S. Pat. No. 2,732,269 to Astroff.

Among the distinct disadvantages of these prior structures include the cost, size and complexity. Birthing chairs and beds cost in the thousands of dollars and are quite bulky. These structures are particularly unsuitable for use in home births, and deliveries made in hospital alternative birthing rooms. In these latter settings, deliveries are typically made on conventional beds. However, conventional beds are generally too soft to provide sufficient support for the woman as she has little or nothing to grasp when experiencing contractions or bearing down during delivery.

It is therefore desirable to have a simple, inexpensive birthing structure which can help brace and support the lower back and pelvis of a woman during labor and delivery, which is particularly suited for use in home births and deliveries made in alternative birthing rooms where conventional beds are used.

SUMMARY OF THE INVENTION

The above and other problems of previous birthing structures are overcome by the present invention of a birthing board constructed of a substantially rigid material having a top surface, a bottom surface, a front end and a back end. The front end of the board has a thickness which is greater than that at the back end so that the top surface at the front end is elevated with respect to the back end, and so that the top surface is generally inclined along a central axis which runs from the back end to the front end. The top surface has a generally concave shape in a dimension transverse to the central axis and is further shaded to provide lumbar support along the central axis. The bottom surface has a convex shape so that cross sections of the board, taken transversely to the central axis, have a bottom curvature of convex shape, and a top curvature of concave shape.

A further feature of the board is that its front end is recessed in the vicinity of the central axis and protrudes on either side of the central axis.

Also included are gripping means located toward the front end of the top surface of the board at the outer edges. In the preferred embodiment the gripping means comprise a pair of handles which flair outwardly from the outer edge of the board, and have a triangular shape. This triangular shape is designed for the convenience of either a short or tall woman.

The front end of the board is designed to support the hips and lower back of the patient, with the back end of the board being narrower and positioned behind the shoulder area. The top surface of the board toward the front end supports the hips and is concave to conform to the buttocks with the surface running along the central axis of the board being contoured in a lumbar curve to provide lumbar support to the lower back. The front end portion of the board is substantially thicker than the back end portion of the board in order to provide a slight upward tilt of the pelvic area. This elevation of the woman's pelvis permits easy observation of the birth. Further advantages include: (1) better hygiene; (2) better access for anesthesia or operative intervention; and (3) better access for repair of any injuries. The gripping means and the curvature of the top surface help to provide a secure surface for the patient to brace against so she can bear down during the delivery. The rounded bottom surface of the board permits the patient to be positioned partially on her side when the board is rotated and supported with a pillow. This helps to relieve the baby's weight on the mother's pelvic veins. In turn, this promotes better return flow of blood from the lower body which: (1) by improving the circulation, provides more blood volume to the uterus; (2) helps prevent hypotension (low blood pressure) to the mother; and (3) provides more efficient circulation of blood, and thereby more oxygen to the baby, lessening fetal distress.

It has also been determined that when a birthing board cover is placed over the top surface of the board during use, the overall effectiveness of the board is improved. This cover is designed to provide a suitable surface for contact with the patient's body by providing: (1) a surface which can be sterilized easily; (2) a surface which can absorb fluids attendant to birth; and (3) a comfortable surface for contact with the patient's body. In the preferred embodiment the cover consists of a felt-like material held onto the rigid portion of the birthing board by means of two pockets, one pocket fitting around the front end of the birthing board, and the other pocket fitting around the back end of the birthing board.

It is therefore an object of the present invention to provide a birthing board which is simple, inexpensive, and easy to use.

It is another object of the present invention to provide a birthing board which is constructed as a single component having a convex bottom surface, a concave top surface which has a curvature to provide lumbar support as well as support for hips and buttocks, and which is substantially thicker in the area where the hip and buttock support is provided.

It is still another object of the present invention to provide a birthing board which can be easily shifted in position and supported by pillows to permit changes in position of the patient's body for her general comfort, to reduce pressure on internal organs, and to reduce fetal distress. Such change in position improves blood flow.

These and other objectives, features and advantages of the present invention will be more readily understood upon considering the following detailed description and drawings.

BRIEF DESCRIPTION OF THE DRAWINGS

FIG. 6 is a plan view of the present invention identifying cross-sectional regions illustrated in FIGS. 7A through 7C and 8A through 8F, as well as providing several dimensions for an illustrative embodiment.

FIG. 7A provides a cross section of the invention along lines 7A—7A of FIG. 6, as well as showing the position of that cross section in relation to a side view of the overall board.

FIG. 7B is a cross section taken along lines 7B—7B of FIG. 6 and illustrates the position of that cross section relative to the bottom portion of the cross section shown in FIG. 7A.

FIG. 7C is a cross section of the invention taken along lines 7C—7C in FIG. 6.

FIGS. 8A through 8F provide a front-end view, and then a sequence of cross sections taken through lines 8B—8B, 8D—8D, 8E—8E, and 8F—8F, respectively, of FIG. 6; with FIGS. 8B and 8C showing the relationship of the cross section with respect to the front-end view of FIG. 8A.

DETAILED DESCRIPTION OF THE PREFERRED EMBODIMENTS OF THE PRESENT INVENTION

Figure 1B:
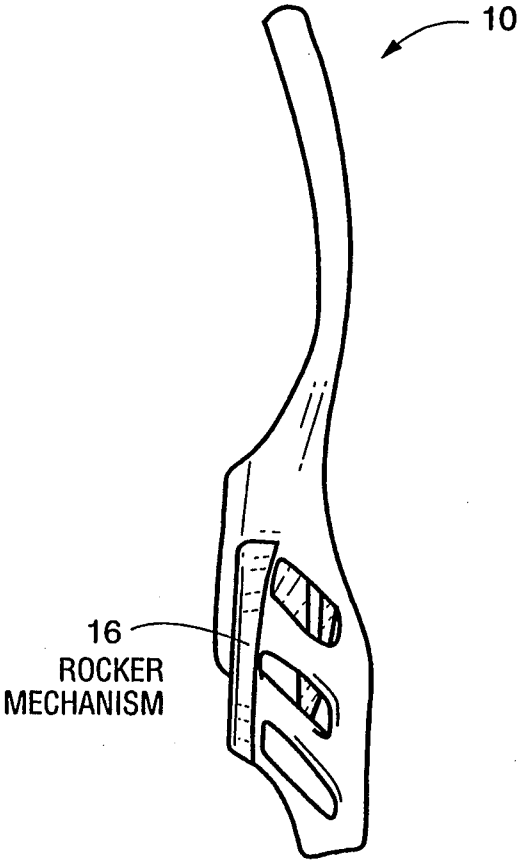
FIG. 1B (PRIOR ART)
FIGS. 1A and 1B are a top and side view, respectively, of a prior exercise structure.
Figure 1A:
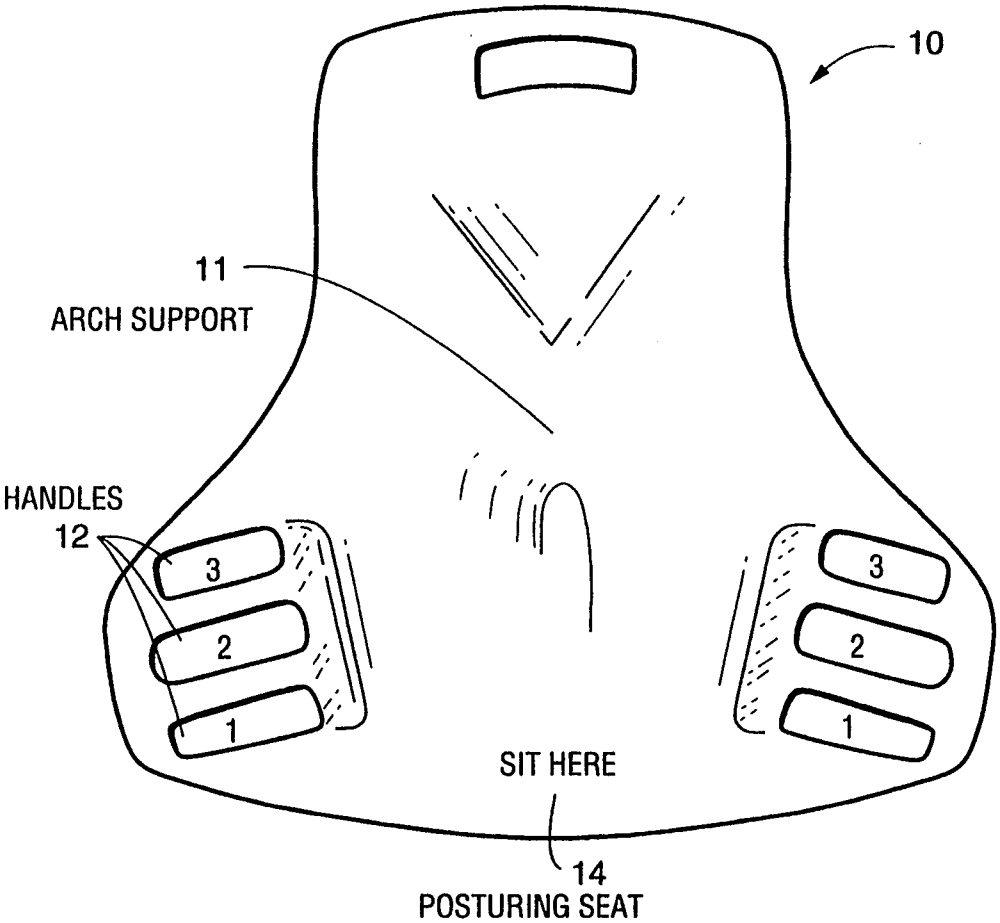
FIG. 1A (PRIOR ART)

Illustrated in FIGS. 1A and 1B is an exercise product 10 which has some structural resemblance to the present invention. The exercise product, manufactured by a company called "Fitness Quest", is known as the "Abdomenizer", and is used in conjunction with an exercise program to strengthen abdominal muscles. As can be seen from FIGS. 1A and 1B, the product 10 has an arch support 11, said to be designed to cushion and cradle the lower back and pelvis, and said to provide "an automatic pelvic tilt" to help support and maintain the lumbar spine in a more neutral position while exercising; handles 12 to assist in positioning and stabilizing; a posturing seat 14 to help with the correct positioning of the buttocks and tail bone in the seated position; and a rocker mechanism 16, FIG. 1B, which is said to permit a slight side-to-side rocking motion and to permit a forward rocking motion which helps to support the pelvic tilt.

However, the product 10 shown in FIGS. 1A and 1B is not intended to be used as a birthing apparatus, nor is it particularly suited for such use.

Figure 3:
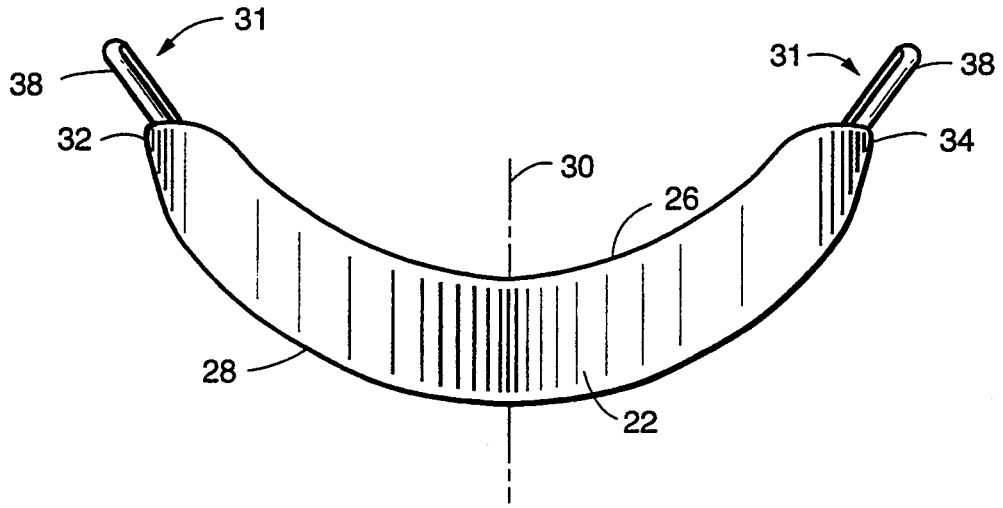
FIG. 3 is a front-end view of the present invention.
Figure 4:
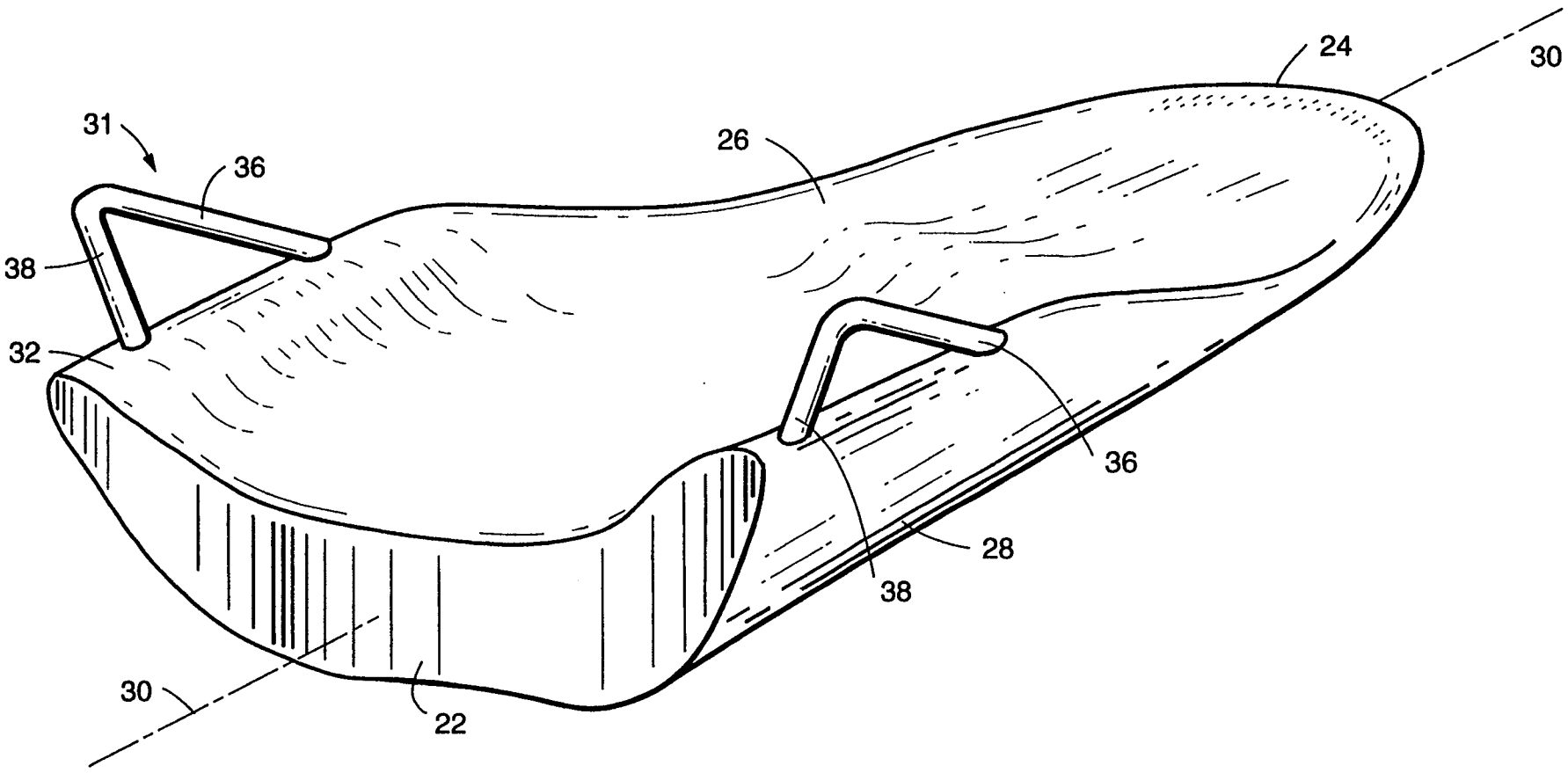
FIG. 4 is a perspective view of the present invention.
Figure 5:
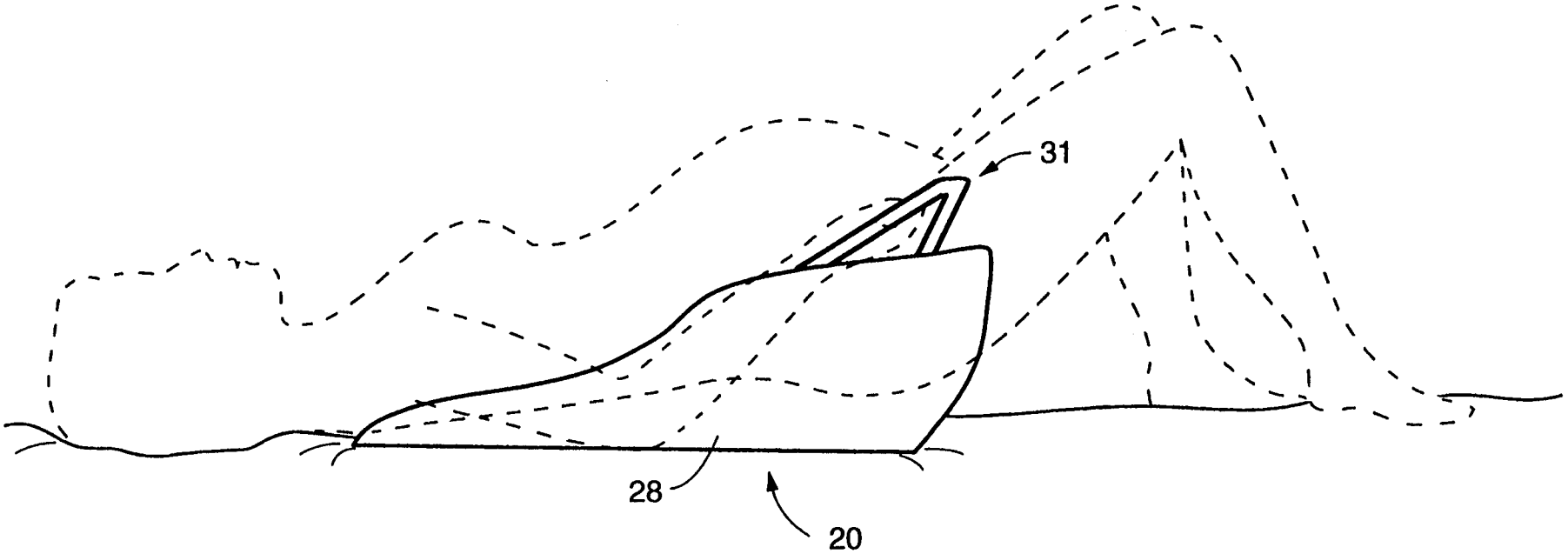
FIG. 5 is a side view of the present invention illustrating the position of a patient, in phantom line, in one application of the invention.

In contrast, the present invention 20 is generally illustrated in FIGS. 2 through 5. As shown in the figures, a plan view of the invention 20 is generally triangular in shape. It has upwardly curved sides and a rounded bottom surface 28. The edges 32, 34 of the curved sides have triangular handles 31 for the woman to grasp. The wider end of the board at the front end 22 serves to support the hips and lower back of the woman with the narrower end being positioned behind the shoulder area, as shown in FIG. 5. The surface of the board supporting the hips is concave to conform to the buttocks with the adjacent surface area toward the center of the board being rounded upwards to support the lower lumbar spinal area. This keeps the woman's hips forward. The lumbar curve support is also believed to reduce back pain.

The portion of the board supporting the pelvic region of the woman is substantially thicker than the remainder of the board, and is designed to provide a slight upward tilt of the pelvic area. This provides the physician with better access to perform the delivery, local anesthesia, episiotomy, and repair. The thicker portion also helps to prevent the woman's hips from sinking too far into the mattress of the bed. The extra elevation provided by the substantially thicker portion of the board also provides for better hygienic conditions. The baby will be born above any accumulation of fluid, blood or fecal material, and in less danger of aspirating such material.

The handles of the invention, and the rigid curvature of the inside surface, help to provide a secure surface for the woman to brace against so she can bear down during the delivery and pull more directly toward the pelvis. These handles are located more closely to the woman's sides, thereby permitting her to direct her strength in the bearing down stage. In contrast, bedside railings, and grips in birthing beds, are spaced much farther away from the woman's side such that pulling on them is awkward and difficult.

The rounded bottom surface of the board helps to allow the woman to be positioned partially on her side when the board is rotated and supported with pillows. This helps to alternate the external pressure areas and can also help to reduce pressure on certain internal organs. Often turning the woman on her left side will improve the circulation of oxygen-carrying blood to the baby. This position is described as Semi-Fowler's position in the article entitled "The Nurse's Role in Antepartum Fetal Assessment," Journal of Perinatology, Spring 1986, Vol. VI, No. 2, pp. 108–113, by Elizabeth A. Kogut, RNC. In such a position a wedge (the birthing board 20) is placed under the right hip, thus displacing the uterus to the left. The article states that this position is essential in preventing supine hypotension caused by pressure from the contents of the uterus on the inferior vena cava and abdominal aorta (aorta-caval syndrome) and that such pressure may decrease blood flow to the uterus and can result in fetal stress. The rounded bottom surface of board 20 permits variation of the amount by which the woman is tilted so that the most comfortable position for her can be obtained.

With the small size and light weight of the invention, it can be kept in the labor room, and quickly set up as needed. There will be no need for any last minute transport of the patient to the delivery room. The laboring woman can remain in bed and need not be moved when she is ready to deliver.

Figure 2:
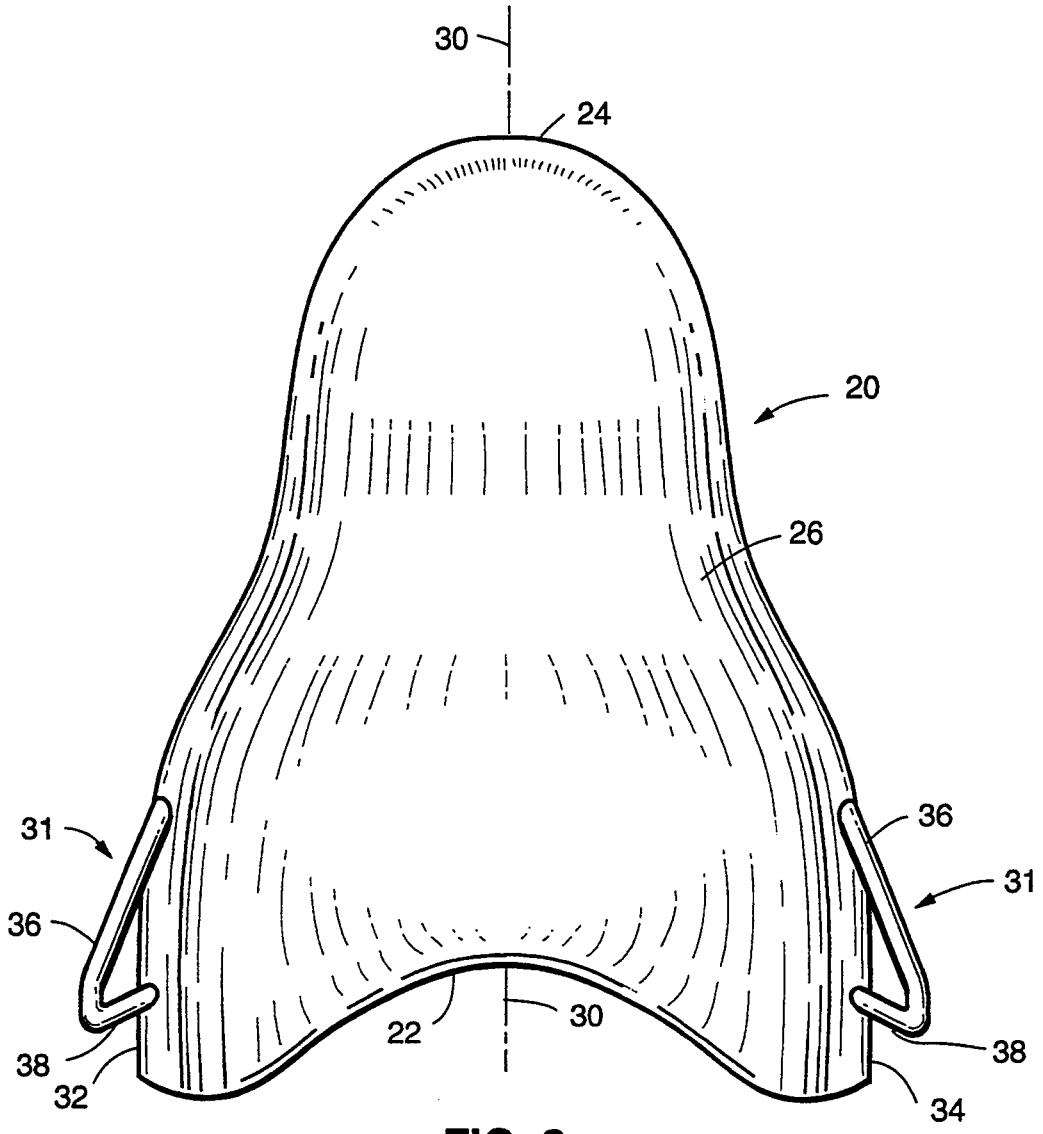
FIG. 2 is a top view of the present invention.

Referring to FIG. 2, more specifically, the invention 20 has a generally triangular shape when viewed from the top, and has a front end 22 and a back end 24. The end-on view of the front end 22, shown in FIG. 3, illustrates how the top surface 26 has a concave shape while the bottom surface 28 has a convex shape.

From FIG. 4 it can be seen that the front end 22 has a thickness which is substantially greater than that of the back end 24, so that the top surface 26 is generally inclined along a central axis 30 which runs from the back end to the front end. It can be seen from FIGS. 2 and 4 that the front end is recessed in the vicinity of the central axis 30.

The wider end of the board has handles 31 protruding upwardly and flaring outwardly from edges 32 and 34. The handles are preferably triangular in shape and are made up of a first section 36 which emerges from the board edges 32 and 34 at an angle of approximately 40° in a direction toward the front end 22 of the board. A second portion 38 extends from the board edges 32, 34 at a point closer to the front end 22 than the portion 36, and at an angle slightly less than 90°, to join with the free end of portion 36. This forms a triangular handle which can be grasped by the patient at either portion 36 or portion 38. Portion 36 can be used by patients of short stature, whereas patients having a taller stature will typically use portion 38 of handle 31.

In other embodiments of the present invention, handle 31 can be formed of the same material as board 20.

As can be seen from FIG. 2, the portion of the board toward the back end 24 is narrower in width than the portion toward front end 22. As stated above, the back end portion 24 is meant to support the shoulder area of the patient, while the front end 22 of the board is meant to support the hips and buttocks of the patient and is therefore wider and more curved.

In the preferred embodiment of the present invention the thickness of the front end in the vicinity of central axis 30 is approximately 4¼ inches. This provides enough height to permit the board to sink into the bed under the patient's weight, while still permitting enough clearance for the physician to obtain clear access to perform the delivery, episiotomy, and other procedures.

Referring to FIGS. 3 and 5, it can be seen that the bottom surface 28 of the board 20 is generally level in dimensions parallel to the central axis 30. It can also be seen that in the dimension transverse to the central axis 30, the bottom surface 28 is formed to have a continuous convex curvature and curves upwardly from the center of the board toward the edges 32 and 34. In use, this curvature permits the board to be tilted or rotated in position to a wide range of angles and then supported by pillows so that the position of the patient can be changed. This can be a great benefit in relieving pressure on certain of the internal organs of the body as well as the baby. In the preferred embodiment of the present invention, the bottom surface 28 is slightly flatter towards its center to provide a degree of stability.

The top surface 26 of the board is curved in a number of different ways to provide support to the patient. For example, from the front end 22 toward the back end 24 a lumbar curve is formed to provide back support to the patient. This can be seen more clearly from the curves in FIGS. 9B and 9C, and specifically region 40 of those curves. Further, support for the tail bone of the patient is provided, as can be seen in region 42 of the curves shown in FIG. 9B and 9C. Region 42 of the curves forms a surface against which the patient can brace herself when pulling on handles 30.

It is to be understood that the curves in FIGS. 9A through 9C, and 10A through 10E were obtained through the use of a contour gauge applied directly to a working prototype of the invention and then transferred onto gridded paper. The curves-on-gridded-paper were then reduced in size to fit within the required drawing size. This permits one to determine more precisely the curvature of the top surface of the board.

From FIGS. 4 and 10-B through 10-D, it can be seen that top surface 26 curves upwardly toward edges 32 and 34 to provide support for the hips and buttocks of the patient. These figures also illustrate how the surface is wider at the front end 22 and narrower toward the back end 24.

Figure 8F:
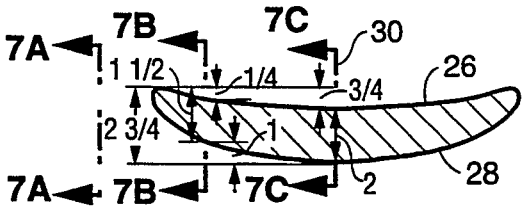
Figure 8E:
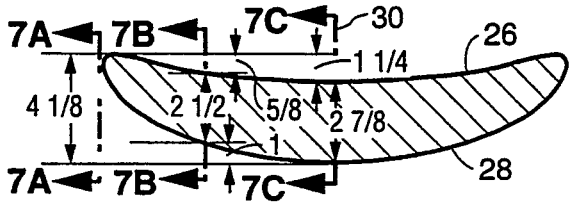
Figure 8D:
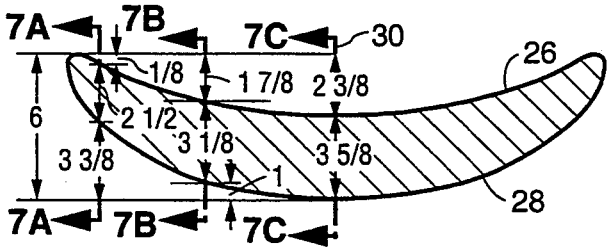
Figure 8C:
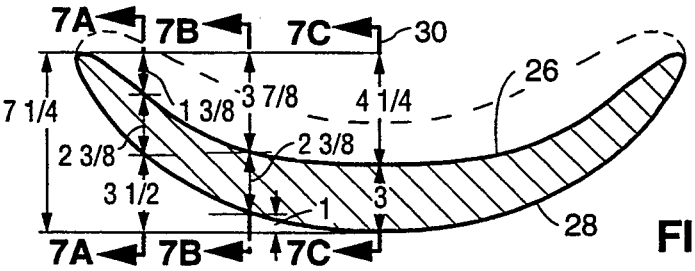
Figure 8B:
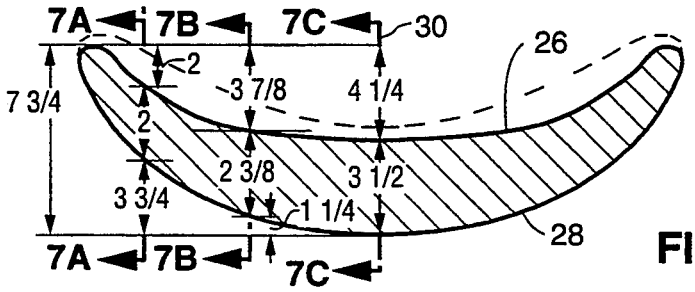
Figure 8A:
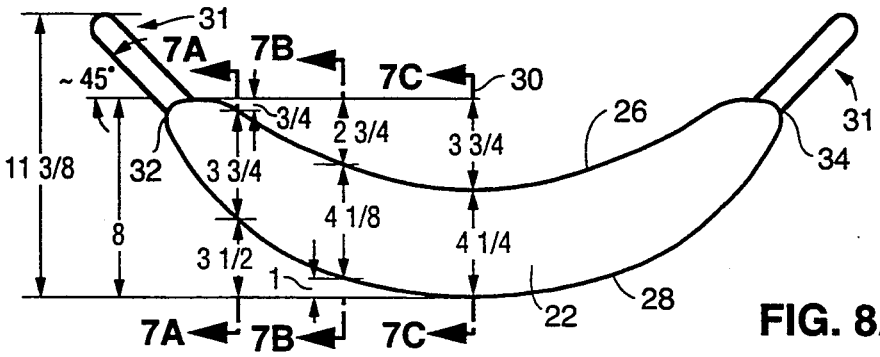
FIG. 8A is a front-end view of the present invention.

Referring to FIGS. 8A through 8F it can be seen how the cross section of the board in a dimension transverse to the central axis 30 progresses from a maximum thickness, FIG. 8A, decreases in thickness, FIGS. 8B and 8C, increases in thickness, FIGS. 8D and 8E, and then decreases in thicknesses again toward the back end 24 of the board, FIG. 8F. This progression can also be seen in FIGS. 7B and 7C.

Also shown in FIGS. 8A through 8F is the generally rounded bottom surface in the dimension transverse to the central axis 30, as well as the generally level bottom surface in the dimension parallel to the central axis 30. Also shown in FIGS. 8A through 8D is the concave shape of the top surface in the wider section of the board toward front end 22.

Included in FIGS. 6 and 8A through 8F are approximate dimensions of the actual working prototype of the present invention as referenced above. The dimensions along line 7C—7C are referenced to the intersection of lines 7C—7C and line 8D—8D. These intersection-dimensions can then be used to provide the relative locations of the various cross sections and curves of FIGS. 7A-C, 8A-F, 9A-C, and 10-B through 10-F.

Thus, it can be seen that the intersection of line 8E—8E with line 7C—7C occurs at 5¼ inches from the intersection of line 8D—8D with line 7C—7C. Similarly, the intersection of line 8F—8F with line 7C—7C occurs at 9½ inches from the intersection of line 8D—SD with line 7C—7C. In a similar manner, the intersection of line 7B—7B with line 8D—8D occurs at 4½ inches from the intersection of line 8D—8D with line 7C—7C.

In FIGS. 8A through 8F several actual, but approximate, dimensions are given for the board at the intersection points called out in FIG. 6. Thus, for example, in FIG. 8A at the point where line 8A—8A intersects line 7A—7A in FIG. 6, the bottom surface 28 is shown to be 3½ inches above the point of the bottom surface at the central axis 30; the board 20 is 3¾ inches thick and the top surface is ¾ inches below edge 32. At the outer edge 32 near line 8A—8A of FIG. 6, the bottom surface 28 is 8 inches above the bottom surface at central axis 30. FIG. 8A shows that the top of handle 31 is 11⅜ inches above the lowest point of bottom surface 28.

Referring to FIGS. 6, 7A and 8A, section 36 of handle 31 is preferably 7 inches long, while section 38 is preferably 4½ inches long. Sections 36 and 38 are joined together by way of a short, preferably 1½ inch section. As can be seen from FIG. 7A, section 36 emerges at an angle of approximately 40° from edge 32 or 34, while portion 38 is approximately 10° from normal, or in other words at approximate right angles to the edge 32 or 34. From FIG. 8A it can be seen that, viewing the board from the front end 22 down along the central axis 30, handles 31 are angled outwardly at approximately 45° from horizontal.

While the prototype of the invention has been constructed of wood, it is envisioned that the invention can also be constructed of fiberglass, blow-molded plastic, vacuum-molded plastic or other material which is rigid enough to provide structural integrity for the board and support for the patient.

Figure 9C:
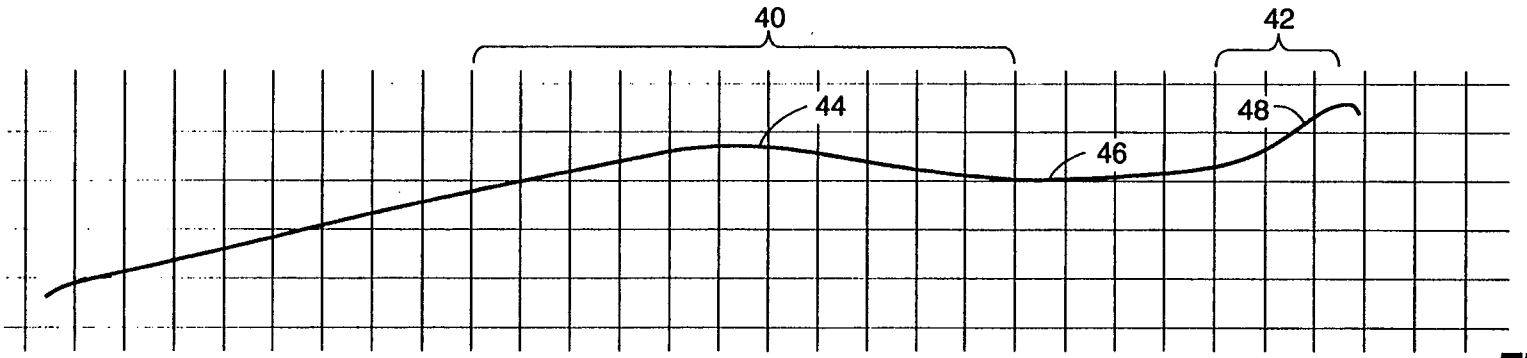
FIGS. 9A through 9C illustrate in reduced form a more exact curvature of the top surface of the invention taken along lines 7A—7A, 7B—7B, and 7C—7C, respectively, of FIG. 6.
Figure 9B:
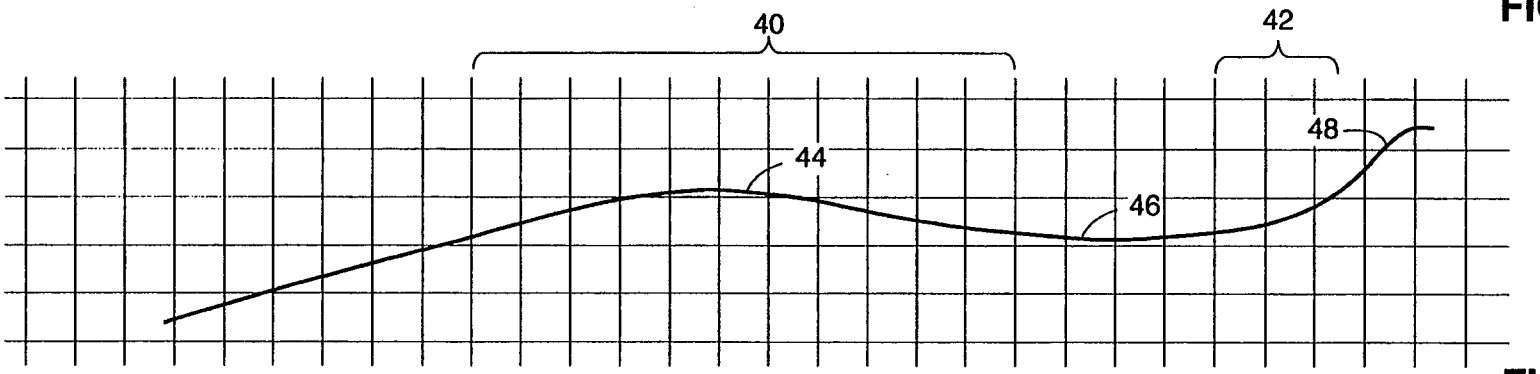
Figure 9A:
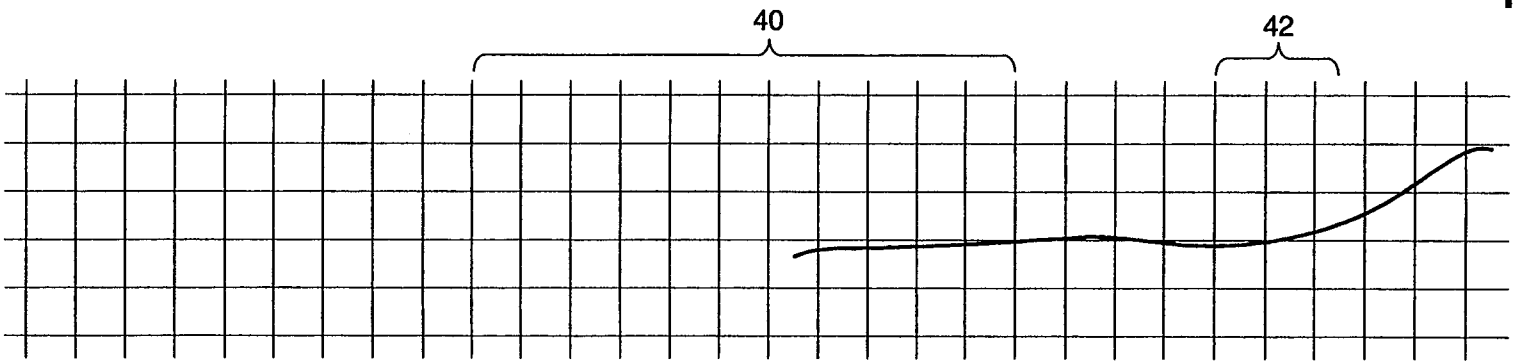
Figure 10B:
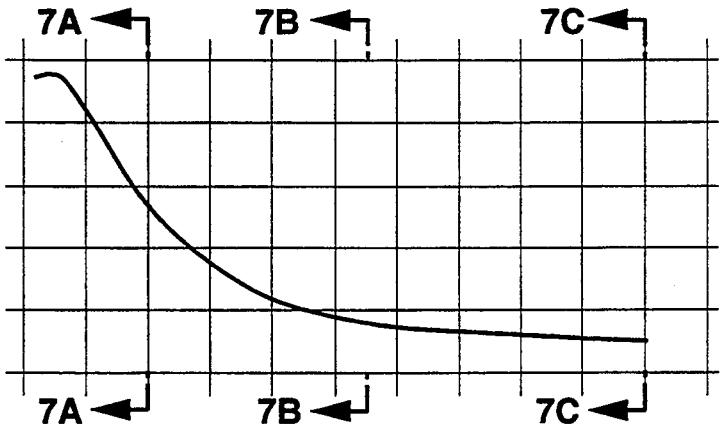
FIGS. 10-B through 10-F show the exact curvature of the top surface of the invention, in reduced form, taken along lines 8B—8B, 8C—8C, 8E—8E, and 8F—8F, respectively, starting at line 7C—7C of FIG. 6 and extending to the left edge in FIG. 6.
Figure 10C:
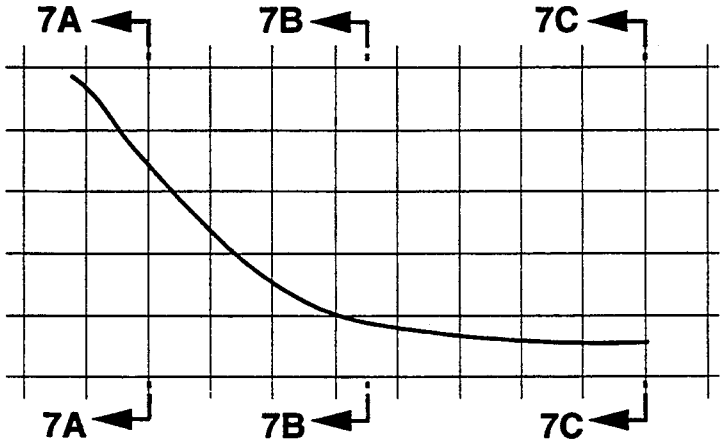
Figure 10D:
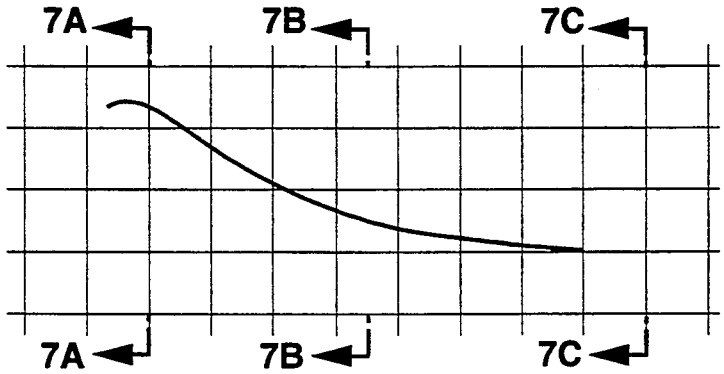
Figure 10E:
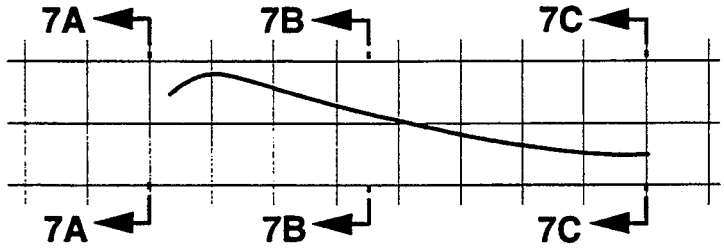
Figure 10F:
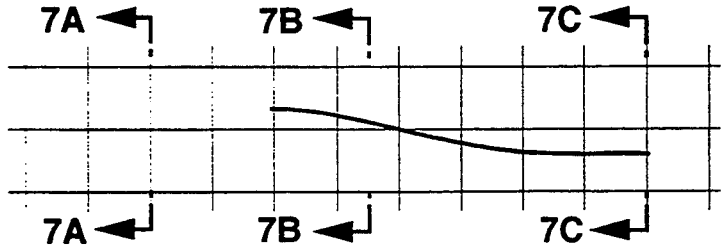

FIGS. 7A through 7C, 8A through 8F, 9A through 9C, and 10-B through 10-F illustrate the different curvatures of each of the surfaces of the invention. FIGS. 7A through 7C should be viewed in conjunction with FIGS. 9A through 9C, with FIGS. 7A through 7C providing a more approximate view while FIGS. 9A through 9C provide more precise dimensions for the surface. FIGS. 7C and 9C show the curvature of the top surface 26 along central axis 30. FIGS. 7B and 9B show the curvature of top surface 26 along lines 7B—7B of FIG. 6. From these two sets of curves it can be seen that there is a rise 44 towards the center of the surface which supports the lumbar portion of the spine, a depression 46 which supports the buttocks, and another rise 48, towards front end 22, which supports the tail bone.

FIGS. 7A through 7C also illustrate how the bottom surface 28 is relatively level in the dimension parallel to the central axis 30. Also to be noted is how the side view of bottom surface 28, in the vicinity of front end 22, is convex in shape, due in part to the recessed area of front end 22 in the vicinity of central axis 30.

It can also be seen from FIGS. 7A and 9A that the top surface is relatively level along the line 7A—7A of FIG. 6.

Referring now to FIGS. 8A through 8F and 10-B through 10-F, the curvature of the top surface in a dimension transverse to the central axis can be viewed. It is to be noted there is no FIG. 10-A in the sequence of FIGS. 10-B through 10-F. This is because these figures are meant to correspond to the cross sections identified by the lines depicted in FIG. 6, with FIG. 10-B corresponding to line 8B—8B, for example. From the sequence 8A through 8F it can be seen how the top surface is at its greatest height above the bottom surface in the vicinity of the central axis and front end 22—approximately 4½ inches. The top surface has a concave shape in this cross section. In FIG. 8B the top surface begins to drop in height and flatten out slightly. In FIG. 8C it can be seen that top surface 26 has dropped even further in height but assumed a curvature more like that in FIG. 8A. In FIG. 8D the height of top surface 26 has begun to increase, with the curvature being similar to that of FIGS. 8C and 8A but slightly shallower. In FIG. 8E the height of top surface 26 has begun to decrease again in the vicinity of central axis 30 and the curvature is flattening out even further. Finally, in FIG. 8F the height of top surface 26 is increased even further, and the curvature has flattened even further. Also to be noted is that the width of top surface 26 in the dimension transverse to central axis 30 tapers noticeably from FIGS. 8C through 8F, while the width is more constant in between FIGS. 8A and 8C. Also to be noted is that the bottom surface 28 has a generally constant curvature between FIGS. 8A and 8F.

It is to be noted that the height of the front end in the vicinity of central axis 30 is selected so that when the invention is used on a mattress and is under the weight of the patient, there is still enough elevation off of the bed to permit continuing hygiene to the perineal area. It is also to be noted that the curvature of the lumbar support section is slightly deeper than the traditional lumbar spine curve to accommodate the protruding spine of the patient and the fact that the patient is in a reclining position.

The dimensions given above are selected to accommodate women of different hip sizes. It has been found that the above dimensions can accommodate women of weights from 90 to 280 pounds.

It is important that the material selected be stiff enough to give firm support to the woman. This permits the pelvic area to be exposed for easy access by the physician. In turn, this permits a more effective examination of the woman and the baby.

Figure 11:
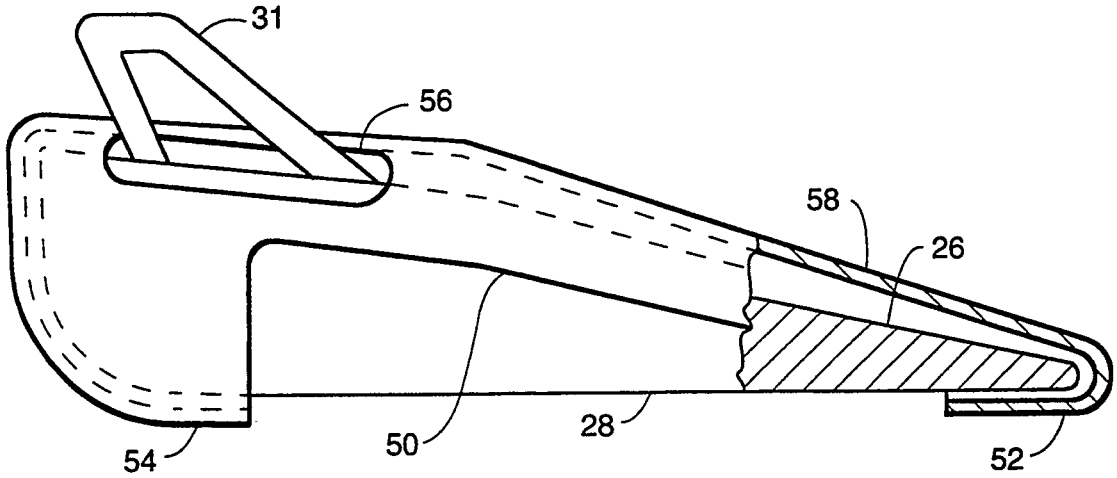
FIG. 11 is a partially cut-away side view illustrating one embodiment of a cover useable with the birthing board of the present invention.

FIG. 11 illustrates a birthing board cover 50 which is positioned on the birthing board by means of a front end pocket 54 and a back end pocket 52. It is envisioned that the cover may also be held in place by elastic edging which can be wrapped around opposing sides of the board and various kinds of straps. While the cover is primarily designed for coverage of the top surface 26, the cover top surface 58 need not follow every contour of the top surface 26 when it is positioned on the board prior to use by the patient. This is because the material selected for the cover top surface 58 is stretchable, and thus will stretch and deform under the weight of the patient. This permits it to conform to the contour of the top surface 26, thereby reducing folds and wrinkles in the cover that can cause patient discomfort. Slots 56 are cut in the cover as appropriate to accommodate the handles 31. The material and thickness of cover should be selected to provide for comfort of the patient and absorbency. Disposable pressed polyester and flannel are examples of appropriate cover materials, although pressed polyester is not as absorbent as flannel. Preferably, the material can be between 1/32 inch and ¼ inch thick. A specific example of suitable cover material is hospital flannel sheet material but which is about twice the standard thickness.

The terms and expressions which have been employed here are used as terms of description and not as limitations, and there is no intention in the use of such terms and expressions of excluding equivalents of the features shown and described, or portions thereof, it being recognized that various modifications are possible within the scope of the invention claimed.

We claim:

1. A birthing board comprising a body of substantially rigid material having a top surface, a bottom surface, a front end adapted to support the hips and lower back of a woman, and a back end adapted to be positioned behind the shoulder area of a woman;

wherein the front end of the body has a thickness which is greater than that at the back end, so that the top surface at the front end is elevated with respect to the back end, and so that the top surface is generally inclined along a central axis which runs from the front end to the back end;

wherein the top surface has a generally concave shape in a dimension transverse to the central axis, and is further shaped to provide lumbar support along the central axis; and wherein the bottom surface has a continuous convex shape, so that cross sections of the body, taken transversely to the central axis, have a bottom curvature of convex shape, and a top curvature of concave shape.

2. The birthing board of claim 1 further wherein the front end of the body is recessed in the vicinity of the central axis and protrudes on either side of the central axis.

3. The birthing board of claim 1 wherein the bottom surface is generally level in dimensions parallel to the central axis.

4. The birthing board of claims 2 or 3 further including means positioned at the front end of the body for gripping by a user of the body.

5. The birthing board of claim 4 wherein the body is constructed of wood.

6. The birthing board of claim 4 wherein the body is constructed of blow-molded plastic.

7. The birthing board of claim 4 wherein the back end of the board has been formed to provide a rounded nose.

8. The birthing board of claim 4 wherein the gripping means comprise a pair of handles positioned toward the front end on the top surface and at the outer edges of the body.

9. The birthing board of claim 8 wherein each of the handles include a first section which extends upwardly from the outer edge of the body at an approximate right angle, and a second section which extends outwardly from the outer edge of the body at a point closer to the back end than the first section, and at an approximate 40 degree angle, and which is joined to a free end of the first section.

10. The birthing board of claim 4 wherein the body is constructed of fiberglass.

11. The birthing board of claim 4 wherein the body is constructed of vacuum molded plastic.

12. The birthing board of claim 1 further including a non-rigid birthing board cover, positioned above the top surface of the body and capable of substantially covering the top surface of the body.

13. The birthing board of claim 12 wherein the birthing board cover is held to the body by means or fitted edging on the cover which can be wrapped around opposing sides of the body.

14. The birthing board of claim 12 wherein the cover is constructed of felt-like material between 1/32 inch and ¼ inch in thickness.

15. A board for supporting a woman during the birthing process comprising a generally rigid structure having a top surface, a bottom surface, a front end adapted to support the hips and lower back of a woman, and a back end adapted to be positioned behind the shoulder area of a woman, to form a generally wedge-shaped profile when viewed from the side;

wherein the top surface slopes generally downwardly from the front end toward the back end along a longitudinal axis, has a concave shape along a dimension transverse to the longitudinal axis, and also is shaped to provide lumbar support along the direction of the longitudinal axis;

wherein the front section is shaped so that it is recessed toward its center and flared towards its ends;

wherein the back section has a rounded shape; and wherein the bottom surface is formed to have a continuous convex curvature in a dimension transverse to the longitudinal axis and generally level in a dimension parallel to the longitudinal axis.

* * * * *